United States Patent [19]

Paris

[11] 4,033,580

[45] July 5, 1977

[54] ELASTIC TYPE EXERCISING

[76] Inventor: Irwin S. Paris, 28 Seacove Drive, Rancho Palos Verdes, Calif. 90274

[22] Filed: Jan. 15, 1976

[21] Appl. No.: 649,372

[52] U.S. Cl. ..... 272/137; 272/142; 272/72

[51] Int. Cl.[2] ..... A63B 21/02; A63B 21/10

[58] Field of Search ..... 272/142, 139, 137, 72, 272/80

[56] References Cited

UNITED STATES PATENTS

| | | | |
|---|---|---|---|
| 1,663,641 | 5/1928 | Smallwood | 272/139 |
| 3,912,266 | 10/1975 | Gary | 272/142 |

FOREIGN PATENTS OR APPLICATIONS

| | | | |
|---|---|---|---|
| 430,528 | 6/1926 | Germany | 272/142 |

*Primary Examiner*—Richard C. Pinkham
*Assistant Examiner*—William R. Browne
*Attorney, Agent, or Firm*—Nilsson, Robbins, Dalgarn & Berliner

[57] ABSTRACT

At least four elongated straps of a highly elastic resilient material, such as stiffened rubber, each having a thickened handle portion at the outer end, extend outwardly in divergent directions from a central junction where the inner ends are integrally joined together and forming one uninterrupted structure. The handles are formed to permit one or more to be held with the hand or foot during performance of various resistive exercises that involve stretching the elastic straps. Preferably the strap, handle and junction portions are integrally molded. The amount of muscular force exerted can be varied in different exercises for maximum effect by selecting the number of straps to be stretched and by adjusting the transverse tension applied to one or more straps held stationary while others are stretched longitudinally.

9 Claims, 16 Drawing Figures

ELASTIC TYPE EXERCISING

BACKGROUND OF THE INVENTION

In recent years, much emphasis has been placed on the benefits of regular exercise in maintaining physical well being and appearance. A steady proliferation of health clubs offering various sorts of exercisng facilities and equipment has been evident, and numerous exercising devices for home use have been widely advertised and sold for those who lack the time, determination or facilities to engage in regular sports activities such as running, tennis, swimming or the like.

The need has long existed for a highly versatile, portable and inexpensive exercising device for home and personal use. Many home exercise devices currently available are of the assistive type wherein repetitive body motions are merely guided or helped. Yet authorities recognize that the benefits of most exercises can be significantly enhanced and performed with greater efficiency by employing resistive devices to place increased loads upon the muscles. Such resistive techniques are now widely used in modern weight training for athletes and in most supervised exercise programs.

Current studies also indicate that the most beneficial exercise results in many instances can be achieved with a limited number of quick repetitions using the maximum resistive force that the exerciser is capable of handling. Thus, as the exerciser gains strength, the resistance must be increased to maintain efficiency. For these purposes, adjustable weight lifting equipment is ideal, but most bar bell and dumb bell equipment is bulky, cumbersome and often even dangerous to use. More elaborate weight training machines are safe but even bulkier and in most instances too expensive to be within the means of many individuals to whom they are available only through health clubs, schools or other recreational facilities.

Although the adjustable twisted rope type of resistive exercisers enjoyed recent popularity as being less bulky and expensive, these did not permit rapid repetitions and could not be readily adapted to different exercises. Current cylinder type devices involving adjustable hydraulic, pneumatic and spring loaded resistance have similar practical limitations in use.

On the other hand, the well known chest expander devices achieve versatility with multiple springs detachably affixed between a pair of handles. With these expanders, the resistive force can be varied simply by changing the number of springs attached between the handles. However, the coil metal springs can pinch the skin or otherwise be extremely uncomfortable, even with a protective cover, if the springs are wrapped around or otherwise pressed against other body members. Also, the handles have to be securely held since, if one end slipped loose, the heavy handle and springs snapping back could injure the exerciser or those around him. Thus, as a practical matter, use of these expanders was for the most part confined to those few exercises wherein the handles could be firmly grasped in both hands with the springs away from the body.

BRIEF DESCRIPTION OF DRAWING

FIG. 6(*b*) illustrates the finished position in the performance of the chest expander exercise illustrated in start position of FIG. 6(*a*);

FIG. 6(*c*) shows an intermediate variation involving greater strength in the performance of the exercise shown in FIGS. 6(*a*) and (*b*);

FIG. 6(*d*) illustrates a further variation requiring maximum strength in the performance of the chest expander exercise shown in FIGS. 6(*a*), (*b*) and (*c*);

Referring now to FIGS. 1–5, which illustrates the preferred form of the resistive exerciser device in accordance with the invention, four elastic straps 10 are each provided with a bifurcated outer end 12 joining a thickened resilient handle portion 14. The inner ends of the straps are joined through an oblong central junction portion 16 shown elongated vertically. In the preferred form, the two straps 10 at either end of this oblong junction portion 16 extend outward from the corner areas at slightly diverging acute angles with the area between adjacent straps forming a smoothly curved edge that allows stretching forces between straps to be directed through the bulk of the central junction portion 16, thus minimizing any tendency to break or tear the material joining the straps.

As shown in FIG. 3, the central junction portion has a substantially flat cross section with rounded edges. The straps 10 themselves preferrably have a somewhat flattened eliptical cross section as shown in FIG. 4, and the thickened handle portions 14 a roughly circular cross section as shown in FIG. 5. In the preferred form, the straps 10, the central junction portion 16, and the thickened handles 14 with the connecting bifurcated sections 12 are all formed integrally in the same molding process to provide maximum strength for the entire structure. Present manufacture is accomplished by conventional compression rubber molding techniques using a latex rubber compound with appropriate vulcanizing, filler and stiffening agents selected to produce a highly elastic resilient material. For example, current manufacturing is accomplished with a "family book" type mold using a commercially available natural rubber compound known as SMR-5L mixed with selected quantities of powdered filler clays such as crown clay, processing oils to inhibit surface oxidation, a silicate stiffener, and an accelerator vulcanizing agent. Such a mixture provides a highly resilient but strong stretchable strap for general use that is ideally about ⅝ths inches wide and about one fourth of an inch thick at its center. Wider and thicker straps 10 with proportional increases in the width and thickness of the central junction portion 16 can be provided for stronger users.

Figure 1:
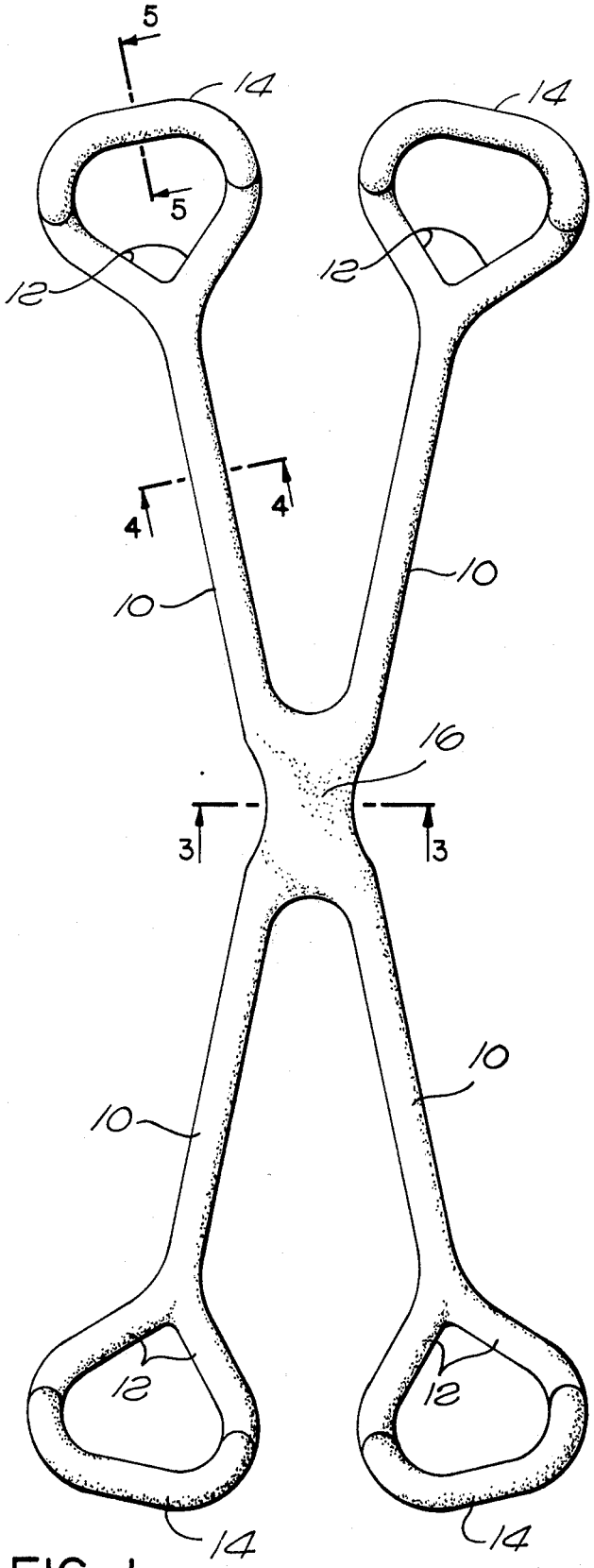
FIG. 1 is a plan view showing the preferred form of the resistive exerciser device in accordance with the invention.
Figure 2:
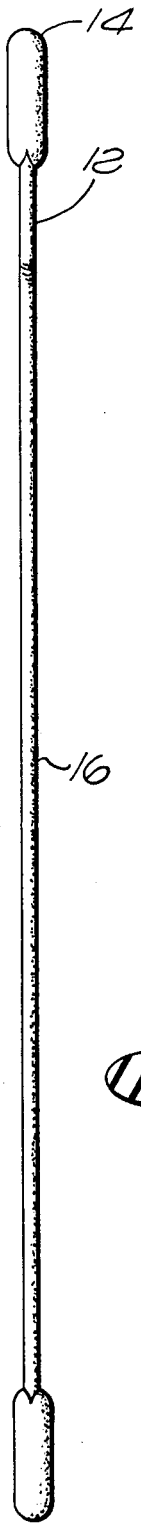
FIG. 2 is a side elevational view of the preferred form of the device shown in FIG. 1.
Figure 5:
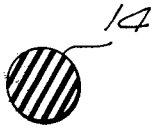
FIG. 5 is a cross-sectional view taken along the lines 5—5 of the handle portion of the device shown in FIG. 1.
Figure 4:
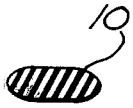
FIG. 4 is a cross-sectional view taken along the lines 4—4 of the device shown in FIG. 1.
Figure 3:
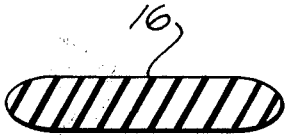
FIG. 3 is a cross-sectional view of the central junction portion of the device shown in FIGS. 1 and 2.
Figure 6A:
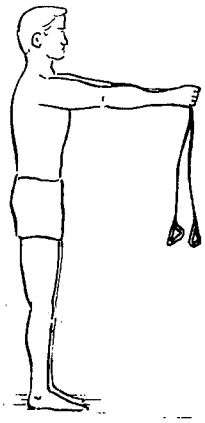
FIG. 6(*a*) illustrates the beginning position of one form of chest expander exercise to be performed with the exerciser device in accordance with the invention.
Figure 6B:
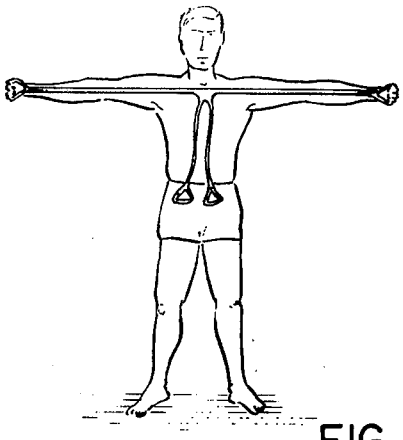
Figure 6C:
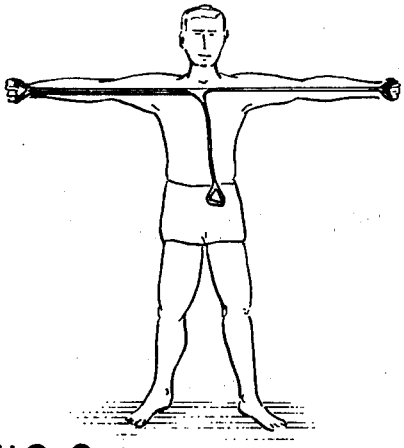
Figure 6D:
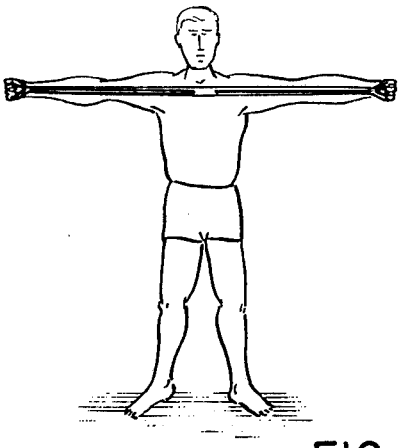

In its preferred form, the distance between the handles measured diagonally along two opposing straps in their unstretched state is approximately 30 inches, which would correspond to the total linear distance between the handles at the start of a typical exercise. With the elongated form of the central portion 16, the starting position between two handles 14 can be decreased 2 to 3 inches to stress the muscles through a greater range of movement and also require greater force to stretch the straps a given distance to reach a final position. For example, the normal chest expander exercise (as hereinafter described in connection with FIG. 6 and 7) might be performed by grasping the two uppermost handles 14 shown in FIG. 1 in opposite hands to begin the exercise, or for the more advanced, by grasping both upper and lower handles 14 on the left-hand side in one hand and the two on the right in the other hand to begin the exercise. In contrast, the resistance is decreased slightly when one or both upper handles 14 are held in one hand, and one or both lower handles 14 in the other.

Referring now to FIGS. 6(*a*), 6(*b*), 6(*c*) and 6(*d*) wherein variations of the basic chest expander exercises are illustrated, the multiple strap and resilient handle construction uniquely facilitate a wide range of variation in the amount of resistive force available for the performance of any exercise. In FIG. 6(*a*), an exerciser is shown in the beginning position of the basic chest expander exercise grasping one of the thickened handle portions 14 in each hand. The arms are then moved horizontally outwards against the relatively light resistive force needed to stretch the two linearly aligned straps. In contrast, in FIG. 6(*c*), the exerciser is shown in the finish position grasping two strap handles 14 in one hand and one handle in the other whereby about 50% more force is required. Finally, in FIG. 6(*d*) each hand grasps two handles 14 so that approximately twice the strength involved in the basic exercise shown in FIG. 6(*b*) is required. With these variations, more than one handle 14 can be grasped safely and comfortably in one hand because the resilient material deforms slightly along the abutting surfaces in response to the hand pressure to act and feel as a unitary handle. In fact, with thickened handle portions approximately ⅝ths inch in diameter, three handles can easily be grasped comfortably in a normal sized hand so that more advanced models might include three or more, instead of only two, strap and handle extensions on either end of the central junction portion 16, thus permitting even greater variations in the resistive force achieved.

Figure 7:
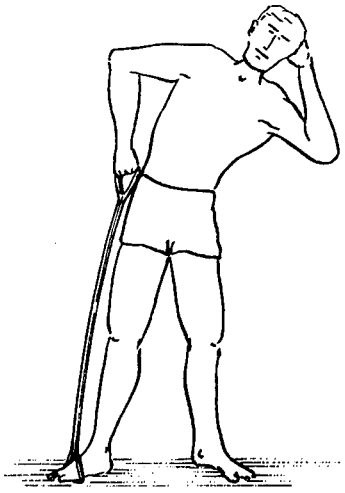
FIG. 7 illustrates performance of a side bend exercise employing the exerciser in accordance with the invention.

Referring now to FIGS. 7 through 13, the versatility of the device in accordance with this invention is exemplified by the almost unlimited variety of exercises that can be performed. In FIG. 7, a conventional side bend exercise is shown wherein one foot is inserted into two handles 14 while the two opposing handles 14 are grasped in one hand supported in a stationary position above the hip. In the beginning upright position, the straps 10 are stretched slightly so that bending of the body to the opposite side produces substantial further stretching that acts as a resistive force. The resilient handle portions 14 are easily held in place by the pressure of a foot against the floor thus avoiding the slipping or rolling action of the rotatable wooden handles commonly used on the older spring type chest expanders, which made such exercises risky.

Figure 8:
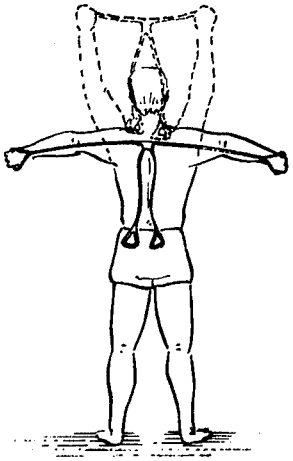
FIG. 8 illustrates performance of a shoulder exercise wherein the starting vertical position of the arms is shown in broken outline and the finished position in solid line drawing.

In FIG. 8, a pull down type exercise is begun, as shown in dotted outline, with both hands above the head each grasping one or more handles. The arms are then rotated vertically downward to the finished position with the straps passing either behind or in front of the head, depending upon the particular effect desired.

Figure 9:
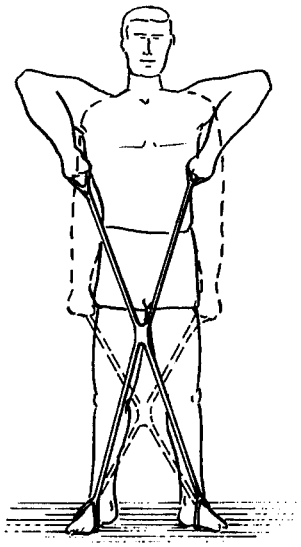
FIG. 9 illustrates in broken outline the beginning position and in solid lines the finish position of a shoulder and back exercise involving a lifting motion.

In FIG. 9, a form of upright lifting exercise is shown being performed with each of the exercisers two feet inserted into one handle opening so that the resilient handles 14 are held firmly against the floor. As shown by the superimposed broken line drawing, the exerciser begins with the arms extended down on each side and then raises both arms and shoulders to the finish position shown by the solid line drawing. With the device in accordance with the invention, this exercise can also be performed with confidence and without fear that the handles will slip free of the foot. In contrast, the prior spring expander devices, particularly those with rotatable wooden or metal grips, were seldom used for such exercises because the pronounced tendency of the handles to roll or slip out from under the foot could result in the heavy metal structure being snapped upwards into the face. For stronger users, both upper handles can be grasped in one hand to perform the exercise one side at a time. For weaker users, only a single strap would be held by one of the feet with both upper handles each held in one hand to be lifted simultaneously. Similarly the familiar curling exercises for the biceps could be performed, and if desired, maximum force obtained by inserting one foot through both lower lower handles.

Figure 10:
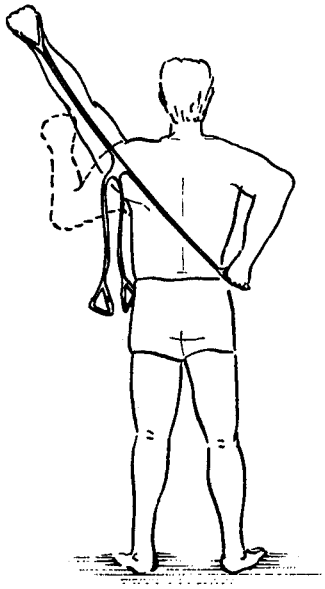
FIG. 10 illustrates in broken outline the beginning position and in solid lines the finish position of an arm exercise using the exerciser in accordance with the invention.

In FIG. 10, one variation of a pressing type exercise is illustrated wherein one or more of the handles is held stationary in one hand on one side of the body near the waist with the straps extending around the back to be grasped by the other hand. In the figure, a starting position is shown in broken outline with the elbow flexed, and then the arm is straightened to the upwardly extended finish position shown by the solid line. Another variation of this exercise would involve extending the arm from the flexed position horizontally outward directly to the front to reproduce the common chest press type motion. The number of straps held in each hand can be varied to adjust the resistive force to the needs of the exerciser. In contrast, spring expander devices used in this manner could cause extreme discomfort with the hard metal springs pressing against the shoulder blades and other back areas.

Figure 11:
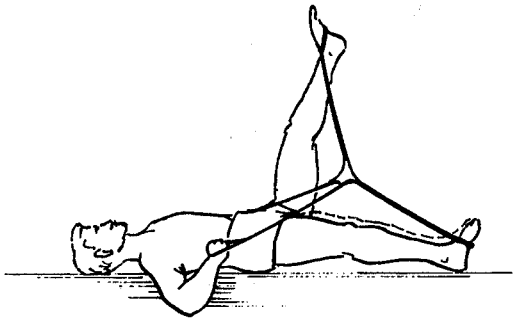
FIG. 11 illustrates the performance of a leg lift exercise using the exerciser in accordance with the invention.
Figure 12:
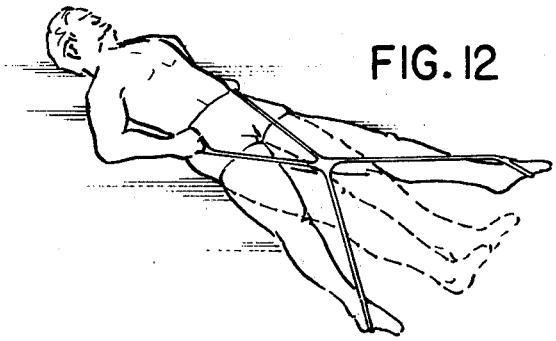
FIG. 12 illustrates the performance of a side leg exercise showing the beginning position in broken outline and the finished position in solid lines using the exerciser in accordance with the invention.

Probably the most unique application of the devices in accordance with the invention is found in the resistive performance of certain leg exercises most popular with women for firming and slimming the thighs. Two variations of such exercises are shown in FIGS. 11 and 12, one involving a leg motion and the other a spreading motion intended to exercise different muscles at the front and back and at the outsides of the thighs, respectively, or the legs can be moved in any other direction relative to each other. Although the human figure in the drawings is shown in a supine position, such exercises may also be performed in a standing position or by lying on one's side. In each of these, the amount of resistive force required in moving the legs apart is controlled by the upward transverse pull on the two other handles held in one or both of the exercisers hands.

Figure 13:
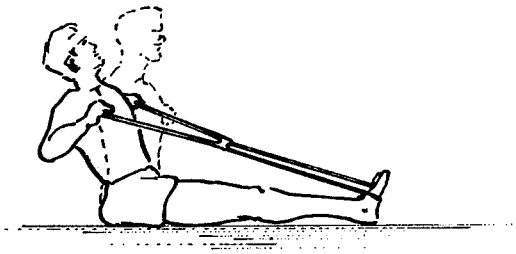
FIG. 13 illustrates the performance of a rowing exercise using the exerciser in accordance with the invention with the beginning position shown in broken outline and the finish in solid lines.

Finally, in FIG. 13, a rowing type exercise is shown wherein the users initially sits in an upright position with legs extended, as shown in broken outline, then moving backward to a half or fully reclining position against the resistive force of the straps, two of which are shown held on the feet and the other two grasped in the hands. If less resistive force is desired, only one handle need be held at the feet, and minimum force can be achieved with the single foot held handle and both hands grasping one other handle. This exercise may similarly be performed in a standing position with the user bent over and straightening up from the waist. However, the usually strong lifting muscles in the back are susceptible to use of much greater resistive forces than normally used for leg and arm movements alone. For that purpose, the user can achieve an optimum resistance by grasping two handles in each hand while holding the flattened central junction portion 16 under one or both feet, or even around an uplifted knee held in a steady position. The resilient flat surface of the central junction portion 16 evenly distributes the force over a relatively large area conforming to the natural contours of the foot or knee to avoid any appreciable discomfort even at such elevated force levels.

The exercises illustrated and described in conjunction with FIGS. 6 through 13 are intended as exemplary only of the great variety of resistive type exercises that can be performed with this versatile device. In other applications, one or more of the handles can be held in a desired position by another exerciser or held on a stationary object such as a post, pipe or doorknob. In home use, two handles can be looped over the handles on opposite sides of a door held ajar. Moreover, the configuration of the preferred embodiment described and illustrated herein can be varied to enhance performance of certain exercises, such as by shortening two straps relative to the other two so that the resistive force is available through a greater range of motion; for example, in leg exercises shown in FIGS. 12 and 13, the longer straps provide little resistance in the initial parting of the feet. It should also be noted that the thickened resilient handle portions 14 provide an excellent grip developer when three or four are squeezed together in one hand, and that pronating and supinating wrist exercises are readily performed by grasping the bifurcated strap portions 12 on opposite sides of the handle 14 in opposite hands to twist in opposite directions.

I claim:

1. A unitary resistive exercise device comprising:

a plurality of at least three straps consisting of a highly elastic resilient material;

handle means of said material affixed to the outer end of each said straps and adapted to be held with the hand or foot of an exerciser; and a central junction portion integrally joining and forming one uninterrupted structure with the inner ends of each of said straps, which radiate therefrom whereby one or more of said handle means are held by selected ones of the exerciser's hands or feet or by an external object to provide a variable resistive force in stretching different combinations of said straps.

2. The resistive exercise device of claim 1 wherein:

said straps, handle means and junction portion are all integrally molded from a stiffened rubber mixture.

3. The resistive exercise device of claim 1 wherein:

said central junction portion consists of a flat oblong section of said elastic resilient material formed integrally with said straps extending outward in diverging directions from the corner areas thereof, whereby the distance between different straps held in an unstretched condition may be varied for different exercises.

4. The resistive exercise device of claim 1 wherein:

each of said handle means consists of a bifurcated outer end section terminating each of said straps to join opposite ends of a thicker handle portion, said bifurcated outer end section and said thicker handle portion being formed integrally with said straps and consisting of said elastic resilient material.

5. The resistive exercise device of claim 1 wherein:

each of said straps is of substantially the same length and thickness;

whereby different pairs of said handle means may be held together to vary the resistive force required to stretch a predetermined distance.

6. A resistive exercise device comprising:

a plurality of at least four resilient handle means adapted to be held by a hand or foot of the exerciser;

a plurality of elastic strap means joining said handles, each of said straps being integrally joined together and forming one uninterrupted structure, said strap being joined approximately midway between said handles, whereby different ones of said handles when aligned in an unstretched condition may be held alone or together to vary the resistive force produced in stretching various straps.

7. The resistive exercise device of claim 6 wherein:

said straps are integrally molded together from a highly elastic resilient material to form a unitary central junction portion of oblong proportions from which said straps extend outwardly in divergent directions.

8. The resistive exercise device of claim 6 wherein:

said handle means are molded integrally with said straps to consist of a highly elastic resilient material to provide a thicker rounded cross section with dimensions that permit a plurality of said handles to be securely grasped together in one hand.

9. The resistive exercise device of claim 6 wherein:

each of said handle means consist of a thicker transverse handle portion joined to said strap on opposite sides by a bifurcated end section to define an opening permitting insertion of a hand, foot or external object to hold said handle.

* * * * *